US010741961B2

(12) United States Patent
Nishida et al.

(10) Patent No.: US 10,741,961 B2
(45) Date of Patent: Aug. 11, 2020

(54) MALE CONNECTOR

(71) Applicants: AutoNetworks Technologies, Ltd., Yokkaichi, Mie (JP); Sumitomo Wiring Systems, Ltd., Yokkaichi, Mie (JP); SUMITOMO ELECTRIC INDUSTRIES, LTD., Osaka-shi, Osaka (JP)

(72) Inventors: Shiro Nishida, Mie (JP); Seido Nishijima, Mie (JP)

(73) Assignees: AutoNetworks Technologies, Ltd. (JP); Sumitomo Wiring Systems, Ltd. (JP); Sumitomo Electric Industries, Ltd. (JP)

( * ) Notice: Subject to any disclaimer, the term of this patent is extended or adjusted under 35 U.S.C. 154(b) by 0 days.

(21) Appl. No.: 16/342,762

(22) PCT Filed: Oct. 6, 2017

(86) PCT No.: PCT/JP2017/036467
§ 371 (c)(1),
(2) Date: Apr. 17, 2019

(87) PCT Pub. No.: WO2018/079231
PCT Pub. Date: May 3, 2018

(65) Prior Publication Data

US 2019/0267743 A1 Aug. 29, 2019

(30) Foreign Application Priority Data

Oct. 26, 2016 (JP) ..... 2016-209302

(51) Int. Cl.
*H01R 4/60* (2006.01)
*H01R 13/50* (2006.01)
(Continued)

(52) U.S. Cl.
CPC ..... *H01R 13/50* (2013.01); *H01R 13/04* (2013.01); *H01R 13/44* (2013.01); *H01R 43/24* (2013.01)

(58) Field of Classification Search
CPC ..... H01R 13/523; H01R 13/5219; H01R 13/4536; H01R 13/005; H01R 13/5227; H01R 13/5205; H01R 13/5216
(Continued)

(56) References Cited

U.S. PATENT DOCUMENTS

| | | | | |
|---|---|---|---|---|
| 9,444,167 | B2 * | 9/2016 | Fukushima | H01R 13/04 |
| 2015/0200481 | A1 * | 7/2015 | Fukushima | H01R 13/04 439/752 |

FOREIGN PATENT DOCUMENTS

| | | |
|---|---|---|
| JP | 44-11748 | 5/1969 |
| JP | 2011-165878 | 8/2011 |
| JP | 2014-72169 | 4/2014 |

OTHER PUBLICATIONS

International Search Report dated Oct. 31, 2017.

* cited by examiner

*Primary Examiner* — Phuong Chi Thi Nguyen
(74) *Attorney, Agent, or Firm* — Gerald E. Hespos; Michael J. Porco; Matthew T. Hespos

(57) ABSTRACT

A male connector 1 includes a housing 11 made of resin and to be fit to a female connector, a male terminal 12 made of metal, partially embedded in the housing 11, projecting forward in a connecting direction from the housing 11 and formed into a tubular shape, resin 12G being filled inside the male terminal, and a resin cap 13 configured to cover a tip of the male terminal 12 on a front side in the connecting direction. The male terminal 12 is provided with a communication opening 12F in a part embedded in the housing 11, the communication opening allowing communication
(Continued)

between inside and outside of the male terminal 12, and a projection 12D is formed on an outer peripheral surface of the embedded part. The housing 11 is formed with a recess 12J configured to expose the projection 12D to outside.

12 Claims, 9 Drawing Sheets

(51) Int. Cl.
*H01R 13/04* (2006.01)
*H01R 43/24* (2006.01)
*H01R 13/44* (2006.01)

(58) Field of Classification Search
USPC ..... 439/201, 271, 138, 190, 191, 204, 206, 439/278, 279, 936
See application file for complete search history.

MALE CONNECTOR

BACKGROUND

Field of the Invention

This specification relates to a male connector.

Related Art

Japanese Unexamined Patent Publication No. 2014-72169 discloses a male connector with a housing, a tubular male terminal having resin filled inside and a resin cap covering a tip of the male terminal on a front side in a connecting direction of the male terminal. A part of the male terminal is embedded in the housing. Resin of the housing, resin filled in the male terminal and resin constituting the resin cap are integrated.

However, in the conventional male connector, when the part of the male terminal is embedded in the housing by molding, there has been a possibility that the male terminal is positionally deviated with respect to the housing due to a forward movement (or rearward movement) of the male terminal in the connecting direction or rotation of the male terminal about an axis caused by an injection pressure of molten resin.

This specification relates to improving the positional accuracy of a male terminal with respect to a housing

SUMMARY

A male connector disclosed in this specification includes a housing made of resin and to be fit to a female connector. A male terminal is made of metal that is formed into a tubular shape and that is embedded partially in the housing. The male terminal projects forward in a connecting direction from the housing, and resin is filled inside the male terminal. A resin cap is configured to cover a tip of the male terminal on a front side in the connecting direction. The male terminal is provided with a communication opening in a part embedded in the housing, the communication opening allows communication between inside and outside of the male terminal. A projection is formed on an outer peripheral surface of the embedded part. The resin of the housing and the resin filled inside the male terminal are integrated via the communication opening and the resin filled inside the male terminal and resin of the resin cap are integrated via an opening of the male terminal on the front side in the connecting direction. Additionally, the housing is formed with a recess configured to expose the projection to the outside.

A contact, for example, at a position to be located in front of the projection in a mold restricts a forward movement by the contact of the projection with the contact even if the male terminal is going to move forward due to an injection pressure. A rearward movement and rotation about an axis can also be restricted by appropriately setting the position of the contact with respect to the projection. However, if the contact is provided in the mold, a part of the housing where the contact portion was present is left as a recess to expose the projection to outside when the mold is released.

Conversely, according to the above-described male connector, the projection is provided on the outer peripheral surface of the part of the male terminal embedded in the housing and the housing is formed with the recess configured to expose the projection to the outside. Thus, forward and rearward movements and rotation about the axis of the male terminal can be restricted when the male terminal is embedded in the housing by molding. Therefore, the positional accuracy of the male terminal with respect to the housing can be improved.

Further, the recess may be formed in a forward facing surface of the housing in the connecting direction to expose the projection forward in the connecting direction. According to the above-described male connector, a forward movement of the male terminal can be restricted when the male terminal is embedded in the housing.

The male terminal may include a slit extending over an entire length at one position in a circumferential direction. If the male terminal is formed into a tubular shape, it is generally lower in cost to form the male terminal by rounding a metal plate into a tubular shape than to form the male terminal by using a pipe. However, if the male terminal is formed by rounding the metal plate into a tubular shape, the male terminal includes a slit extending over the entire length at one position in the circumferential direction. Conversely, since the male terminal includes the slit extending over the entire length at one position in the circumferential direction according to the above-described male connector, the male terminal can be formed by rounding the metal plate into a tubular shape. Thus, manufacturing cost can be reduced as compared to the case of using a pipe.

Further, the projection may be separated from an outer peripheral wall of the male terminal except at a base end and may rise outward from the outer peripheral wall. Accordingly, the projection can be provided by so-called cutting and raising.

The projection may be a convex part formed on the outer peripheral surface and a recess may be formed at a position corresponding to the convex part in an inner peripheral surface of the male terminal. Accordingly, the projection can be provided by so-called striking.

The projection may be separated from the outer peripheral wall of the male terminal except at the base end and may protrude outward via a step. Accordingly, the projection can be provided by so-called separation and bending.

According to this specification, the positional accuracy of a male terminal with respect to a housing can be improved.

DETAILED DESCRIPTION

First Embodiment

A first embodiment is described on the basis of FIGS. 1 to 5. In the following description, a vertical direction, a front-rear direction and a lateral direction are based on a vertical direction, a front-rear direction and a lateral direction shown in FIG. 1. A front side is an example of a front side in a connecting direction, and a rear side is an example of a rear side in the connecting direction.

(1) Configuration of Male Connector

Figure 1:
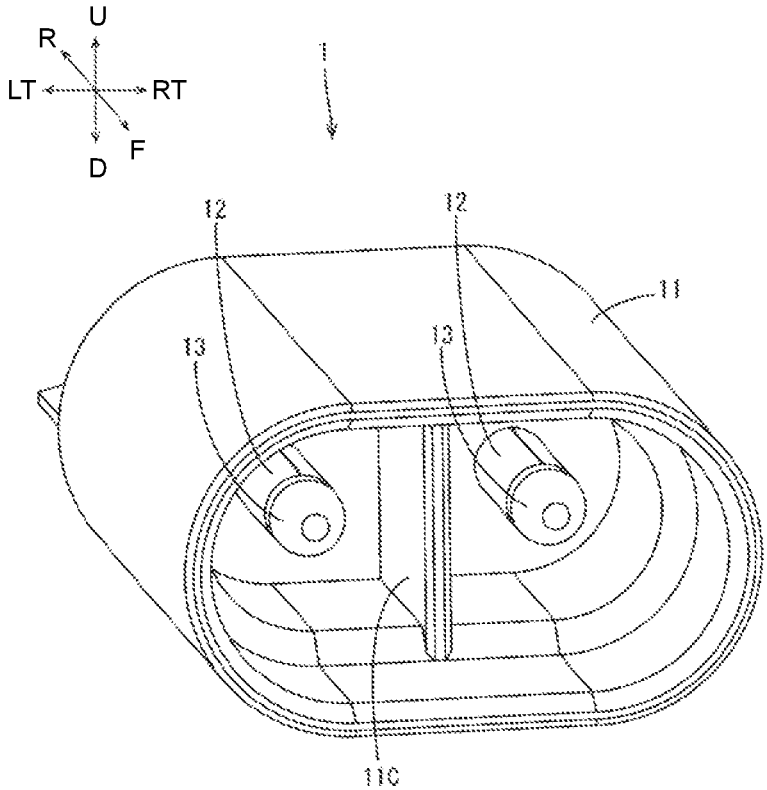
FIG. 1 is a perspective view of a male connector according to a first embodiment.
Figure 2:
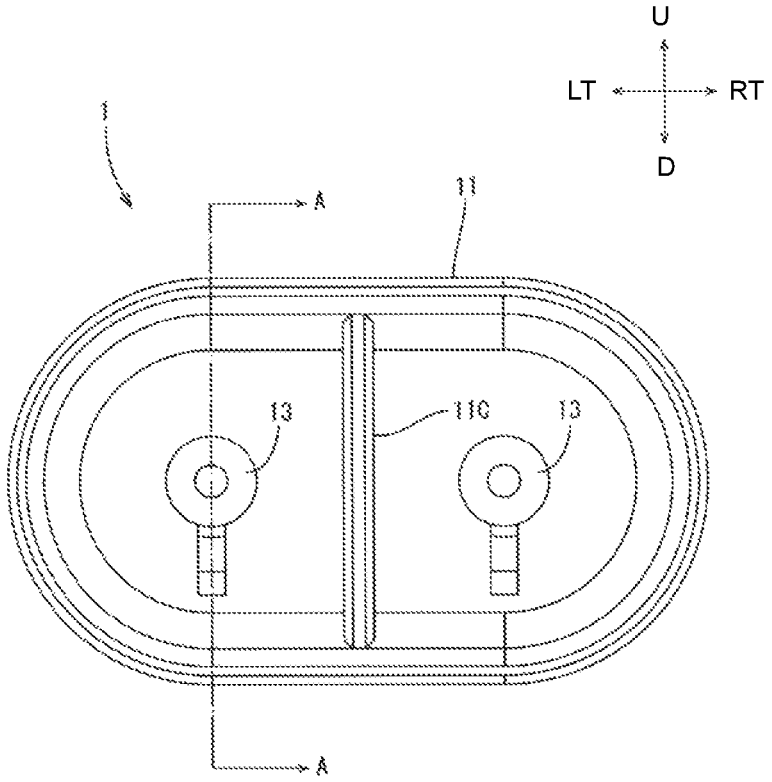
FIG. 2 is a front view of the male connector.

A male connector 1 according to the first embodiment is outlined with reference to FIGS. 1 and 2. The male connector 1 is mounted in a vehicle to electrically connect in-vehicle devices and includes a housing 11 (FIGS. 1 and 2) made of resin, two male terminals 12 (FIG. 1) and resin caps 13 (FIGS. 1 and 2) for covering tips of the male terminals 12.

(1-1) Housing

As shown in FIG. 1, the housing 11 has a so-called race track shape composed of two straight lines and two semicircles when viewed from the front. The housing 11 includes a receptacle, and an unillustrated female connector is fit and inserted into the receptacle from the front.

Figure 3:
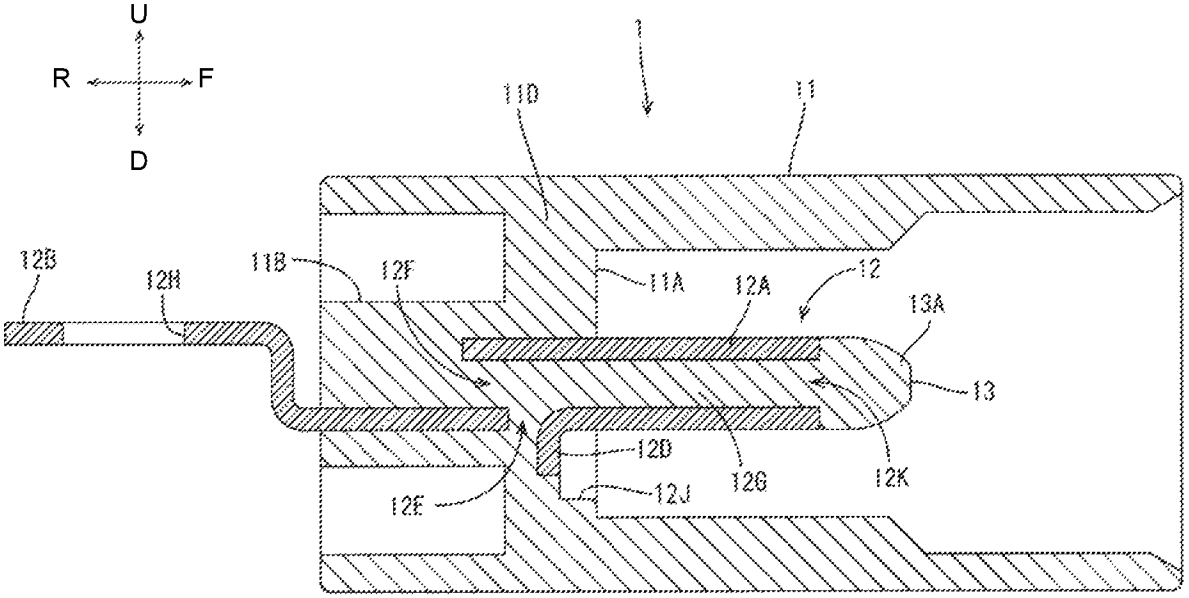
FIG. 3 is a section along A-A shown in FIG. 2.

As shown in FIG. 3, a back wall 11A is formed integrally inside the housing 11 for partitioning an internal space into front and rear sections. A terminal holding portion 11B is formed integrally to extend rearward behind the back wall 11A and parts of the male terminals 12 are embedded therein. Further, as shown in FIG. 1, a partition wall 11C is formed integrally between the two male terminals 12 inside the housing 11. The front end position of the partition wall 11C is aligned substantially with front ends of the resin caps 13.

(1-2) Male Terminals

As shown in FIG. 3, an intermediate part of the male terminal 12 in a longitudinal direction is embedded in the back wall 11A and the terminal holding portion 11B of the housing 11, a front side thereof projects forward from the back wall 11A, and a rear part thereof comes out rearward from the terminal holding portion 11B.

Figure 4:
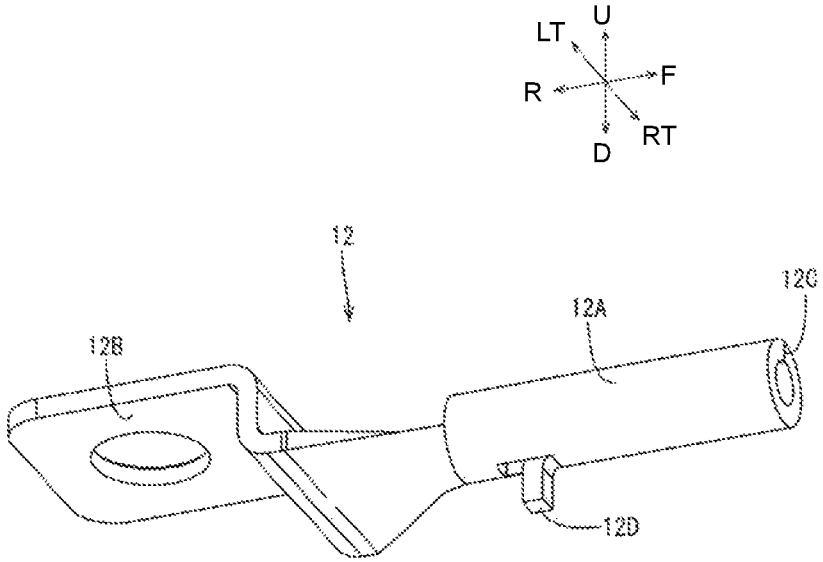
FIG. 4 is a perspective view of a male terminal.

The shape of the male terminal 12 is described more specifically with reference to FIG. 4. The male terminal 12 is formed by bending a plate that has been stamped to define a predetermined shape and that is formed from metal, such as copper or copper alloy. More particularly, the male terminal 12 includes a tubular portion 12A and a conductor connecting portion 12B extending from a rear side of the tubular portion 12A.

The tubular portion 12A is formed by bending a front part of the metal plate into a tubular shape from both left and right sides, and includes a slit 12C extending over the entire length at one position in a circumferential direction. Specifically, this slit 12C is formed by bending the metal plate to form the tubular portion 12A.

A projection 12D in the form of a rectangular column is formed by cutting and raising on an outer peripheral wall of the tubular portion 12A. Specifically, the projection 12D is separated from the outer peripheral wall of the tubular portion 12A except at a base end, and rises outward from the outer peripheral wall. Since the projection 12D is formed by cutting and raising, an opening 12E is formed in the outer peripheral wall of the tubular portion 12A. As shown in FIG. 3, the projection 12D is formed in a part of the tubular portion 12A to be embedded in the housing 11.

As shown in FIG. 3, the tubular portion 12A is open on both front and rear ends, and an opening 12F on the rear end is embedded in the housing 11. In the following description, the opening 12F on the rear end is referred to as a communication opening 12F. Resin 12G is filled inside the tubular portion 12A, and resin 11D constituting the housing 11 and the resin 12G filled inside the tubular portion 12A are integrated via the communication opening 12F and the opening 12E.

The conductor connecting portion 12B is for fastening a busbar by a bolt, and is formed with a through hole 12H through which the bolt is inserted. In this embodiment, the position of the busbar with respect to the connector is fixed and the conductor connecting portion 12B is bent into a key shape (bent substantially at 90° toward an opposite side after being bent substantially at 90°) to be aligned positionally with the busbar. Note that the conductor connecting portion 12B may not be bent if the busbar and the conductor connecting portion 12B can be overlapped without bending the conductor connecting portion 12B. Alternatively, the conductor connecting portion 12B may be shaped by being bent at 90° only once so that plate surfaces thereof face in the front-rear direction.

As shown in FIG. 3, the back wall 11A of the housing 11 is formed with a recess 12J for exposing the projection 12D to outside. Specifically, the recess 12J according to the first embodiment is recessed rearward from a forward facing surface of the back wall 11A, and exposes the projection 12D forward.

(1-3) Resin Cap

As shown in FIG. 3, the resin cap 13 is provided on the front side of the male terminal 12. The resin cap 13 is provided as a countermeasure against finger touch (electric shock) to prevent a finger of a worker from touching the tip of the male terminal 12. As shown in FIG. 3, the resin 12G filled inside the tubular portion 12A and resin 13A constituting the resin cap 13 are integrated via an opening 12K on the front of the tubular portion 12A.

(2) Molding of Male Connector

Figure 5:
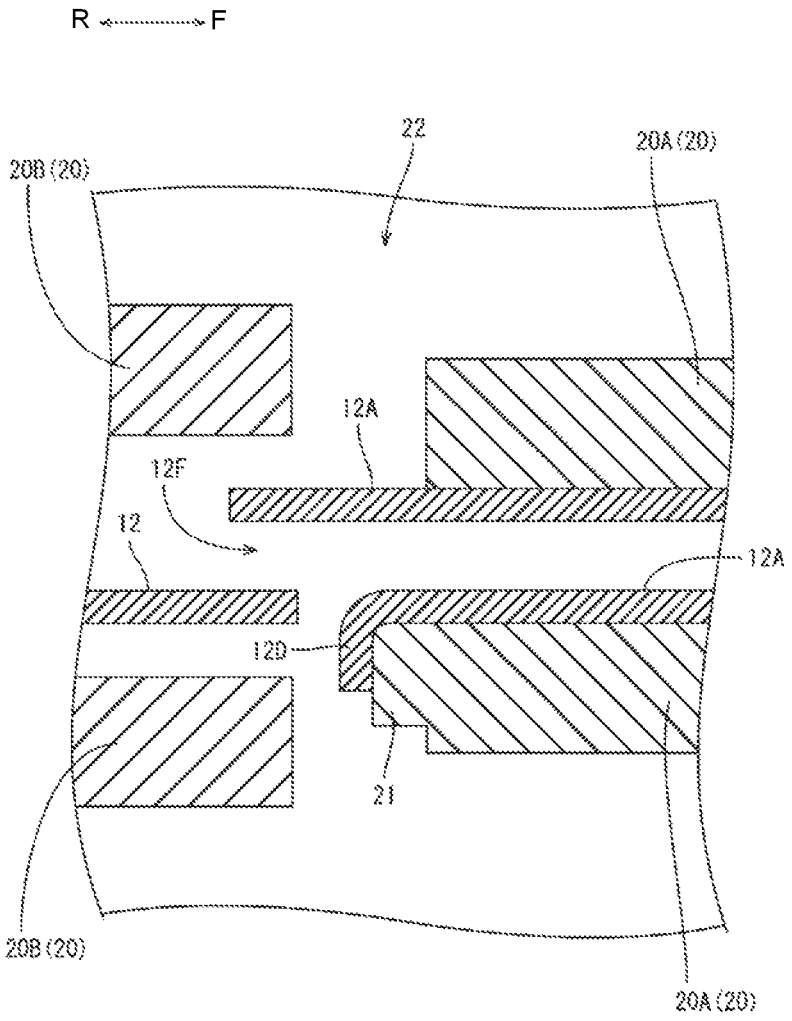
FIG. 5 is a section enlargedly showing a part of a mold before resin is filled.

In molding the male connector 1, the male terminals 12 are set in a mold 20 (20A, 20B), as shown in FIG. 5. Note that the mold 20 before resin is filled into an internal space 22 is shown in FIG. 5. The mold 20 is provided with contact portions 21 at positions to be located in front of the projections 12D of the male terminals 12. When the male terminals 12 are set in the mold 20, the projections 12D contact the contact portions 21 from behind. Note that tiny clearances may be present between the projections 12D and the contact portions 21 when the male terminals 12 are set in the mold 20.

Subsequently, molten resin is filled into the internal space 22 of the mold 20. In this embodiment, it is assumed that the molten resin is filled from behind. The communication openings 12F of the male terminals 12 are embedded in the housing 11, as described above. Thus, the molten resin flows into the tubular portions 12A through the communication openings 12F when the molten resin is filled into the mold 20. The molten resin that flows into the tubular portion 12A partially flows out from the openings 12A on the front end and the resin caps 13 are formed by the outwardly flowing molten resin.

The projections 12D of the male terminals 12 are in contact with the contact portions 21 from behind in the mold 20, as described above. Thus, even if the male terminals 12 are going to move forward due to an injection pressure of the molten resin filled from behind, the projections 12D contact the contact portions 21 to restrict forward movements.

Alternatively, even if tiny clearances are present between the projections 12D and the contact portions 21 when the male terminals 12 are set in the mold 20, further forward movements of the male terminals 12 from positions where the projections 12D are in contact with the contact portions 21 are restricted since the male terminals 12 are moved slightly forward by the injection pressure and the projections 12D contact the contact portions 21.

The mold 20 is released after the resin is filled into the internal space 22 of the mold 20. When the mold 20 is released, parts where the contact portions 21 were present are left as the recesses 12J (see FIG. 3) in the back wall 11A of the housing 11 and the projections 12D are exposed forward by those recesses 12J.

(3) Effects of Embodiment

According to the male connector 1 of the first embodiment, the contact portions 21 are provided at the positions to be located in front of the projections 12D in the mold 20, as shown in FIG. 5. Thus, even if the male terminals 12 are going to move forward due to the injection pressure, the projections 12D contact the contact portions 21 to restrict forward movements. However, if the mold 20 is provided with the contact portions 21, the parts where the contact portions 21 were present are left as the recesses 12J in the housing 11, as shown in FIG. 3, and the projections 12D are exposed forward in the connecting direction when the mold 20 is released.

Conversely, according to the male connector 1, the projection 12D is provided on the outer peripheral surface of a part of the tubular portion 12A to be embedded in the housing 11 and the recess 12J for exposing the projection 12D forward is formed in the forward facing surface of the housing 11 (more specifically, of the back wall 11A). Thus, a forward movement of the male terminal 12 can be restricted when the male terminal 12 is embedded in the housing 11 by molding. Therefore, the positional accuracy of the male terminal 12 with respect to the housing 11 can be improved.

Further, according to the male connector 1, the tubular portion 12A includes the slit 12C extending over the entire length at one position in the circumferential direction. Thus, the tubular portion 12A can be formed by rounding the metal plate into a tubular shape, and manufacturing cost can be reduced as compared to the case of using a pipe.

Further, according to the male connector 1, the projection 12D can be provided by so-called cutting and raising.

Second Embodiment

Next, a second embodiment is described with reference to FIGS. 6 and 7.

Figure 6:
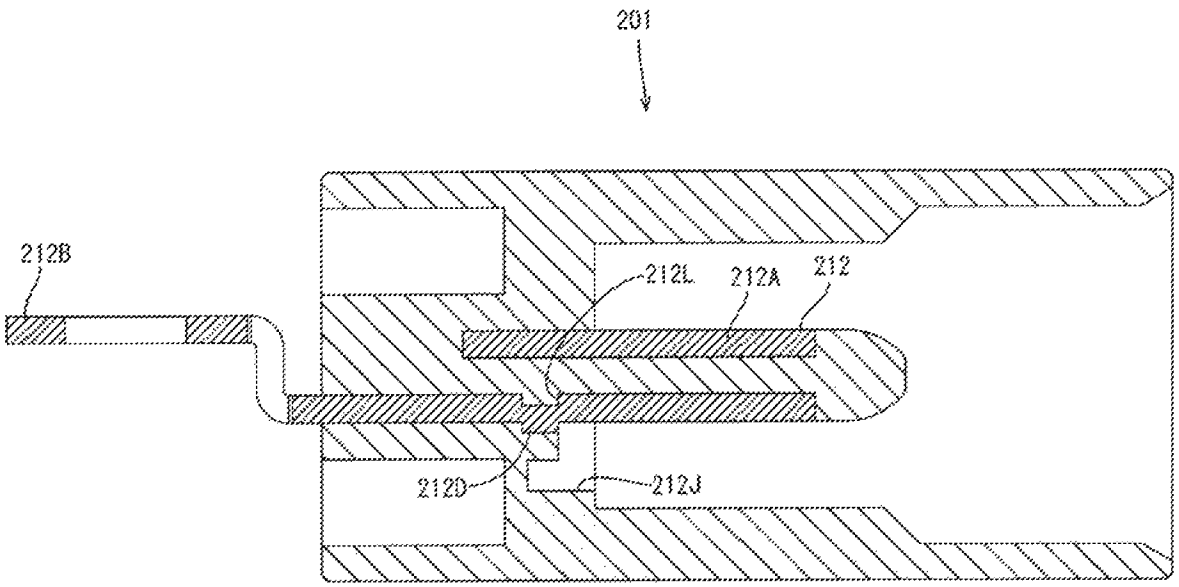
FIG. 6 is a section of a male connector according to a second embodiment.
Figure 7:
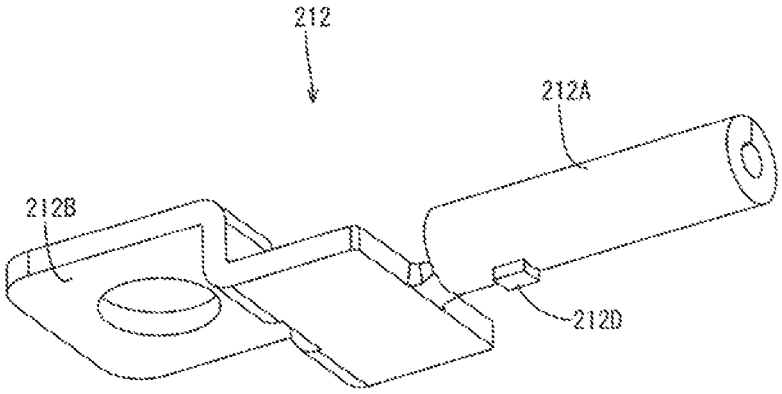
FIG. 7 is a perspective view of a male terminal.

As shown in FIGS. 6 and 7, a projection 212D is formed by striking in a male connector 201 according to the second embodiment. Specifically, the projection 212D is a convex part formed on an outer peripheral wall of a tubular portion 212A and is formed by striking so that a recess 212L is formed at a position corresponding to the convex part in an inner peripheral surface of the tubular portion 12A. Since the projection 212D is formed by striking in the second embodiment, an opening equivalent to the opening 12E of the first embodiment is not formed in the outer peripheral wall of the tubular portion 212A.

Third Embodiment

Next, a third embodiment is described with reference to FIGS. 8 and 9.

Figure 8:
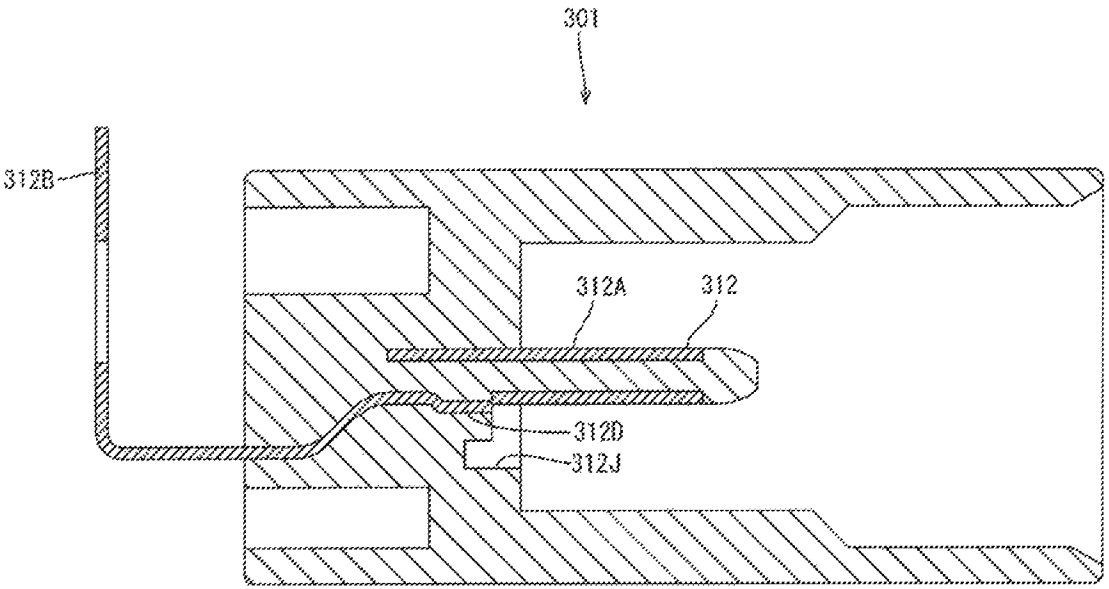
FIG. 8 is a section of a male connector according to a third embodiment.
Figure 9:
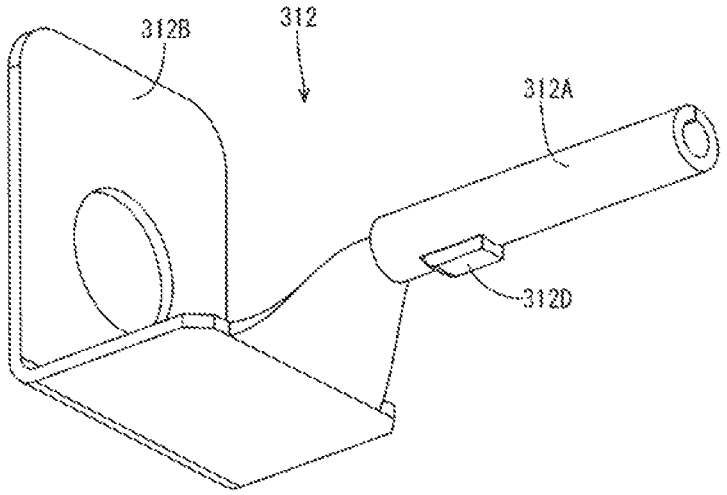
FIG. 9 is a perspective view of a male terminal.

As shown in FIGS. 8 and 9, a projection 312D according to the third embodiment is separated from an outer peripheral wall of a tubular portion 312A except at a base end and is formed by bending a base end side to form a step having a height smaller than a thickness of the outer peripheral wall. Specifically, the projection 312D is separated from the outer peripheral wall except at the base end and protrudes outward via the step having the height smaller than the thickness of the outer peripheral wall.

Further, as shown in FIG. 9, a conductor connecting portion 312B is bent at 90° instead of being bent into a key shape in the third embodiment. Note that, also in the third embodiment, the conductor connecting portion 312B may be bent into a key shape, as in the first or second embodiment.

According to a male connector 301 of the third embodiment described above, the projection 312D can be provided by so-called separation and bending.

Note that although the height of the step is smaller than the thickness of the outer peripheral wall in the example described here, the height of the step may be equal to or larger than the thickness of the outer peripheral wall.

Other Embodiments

The invention is not limited to the above described and illustrated embodiments. For example, the following embodiments also are included in the scope disclosed by this specification.

In the above embodiment, the forward facing surface of the projection 12D comes into contact with the contact portion 21. In contrast, the contact portion 21 may be configured so that a side surface (surface facing forward of the plane of FIG. 3 and surface facing backward of the plane of FIG. 3) of the projection 12D comes into contact with the contact portion 21. By this configuration, the rotation of the male terminal 1 about the axis can be restricted in molding. Note that, in this case, the side surface of the projection 12D is exposed to outside.

Alternatively, the contact portion 21 may be so configured that not only the forward facing surface of the projection 12D comes into contact with the contact portion 21 as in the first embodiment, but also the side surface comes into contact with the contact portion 21 as described above. By this configuration, a forward movement of the male terminal 12 can be restricted and the rotation of the male terminal 12 about the axis can also be restricted in molding.

Although the molten resin is filled from behind in the above embodiments, the molten resin may be filled from the front. Specifically, for example, the molten resin may be filled through the opening 12K on the front side of the tubular portion 12A and the housing 11 may be formed by the molten resin that flows out from the opening 12F on the rear side of the tubular portion 12A. In that case, since the male terminal 12 is going to move rearward due to an injection pressure, a contact portion 21 may be provided at a position to be located behind the projection 12D in the left mold 20B. In this case, the projection 12D is exposed rearward.

Although the tubular portion 12A is formed by rounding the metal plate in the above embodiment, the tubular portion 12A may be formed using a pipe.

Although the opening 12F on the rear side of the tubular portion 12A serves as the communication opening 12F in the above embodiment, the communication opening 12F may be a through hole formed in the outer peripheral wall of the tubular portion 12A. For example, if the tubular portion 12A is formed using a pipe, it is also possible to form a terminal connecting portion by squeezing a rear end part of the tubular portion 12A into a flat plate. In that case, the tubular portion 12A does not include the opening 12F in the part embedded in the back wall 11A, and the communication opening 12F may be provided by forming a through hole in the outer peripheral wall.

LIST OF REFERENCE SIGNS

1 . . . male connector,
11 . . . housing,
11D . . . resin,
12 . . . male terminal,
12A . . . tubular portion,
12C . . . slit,
12D . . . projection,
12F . . . communication opening,
12G . . . resin,
12J . . . recess,
12K . . . opening,
13 . . . resin cap,
13A . . . resin,
201 . . . male connector,
212 . . . male terminal,
212A . . . tubular portion,
212D . . . projection,
212L . . . recess,
212J . . . recess,
301 . . . male connector,
312 . . . male terminal,
312A . . . tubular portion,
312D . . . projection,
312J . . . recess

The invention claimed is:

1. A male connector, comprising:

a housing made of resin and to be fit to a female connector;

a male terminal made of metal, partially embedded in the housing, projecting forward in a connecting direction from the housing and formed into a tubular shape, resin being filled inside the male terminal; and a resin cap configured to cover a tip of the male terminal on a front side in the connecting direction;

wherein:

the male terminal is provided with a communication opening in a part embedded in the housing, the communication opening allowing communication between inside and outside of the male terminal, and a projection is formed on an outer peripheral surface of the embedded part;

the resin constituting the housing and the resin filled inside the male terminal are integrated via the communication opening and the resin filled inside the male terminal and resin constituting the resin cap are integrated via an opening of the male terminal on the front side in the connecting direction; and the housing is formed with a recess configured to expose the projection to outside;

the recess is formed in a forward facing surface of the housing in the connecting direction to expose the projection forward in the connecting direction; and the male terminal includes a slit extending over an entire length at one position in a circumferential direction.

2. The male connector of claim 1, wherein the projection is separated from an outer peripheral wall of the male terminal except at a base end and rises outward from the outer peripheral wall.

3. The male connector of claim 1, wherein the projection is a convex part formed on the outer peripheral surface and a recess is formed at a position corresponding to the convex part in an inner peripheral surface of the male terminal.

4. The male connector of claim 1, wherein the projection is separated from an outer peripheral wall of the male terminal except at a base end and protrudes outward via a step.

5. A male connector, comprising:

a housing made of resin and to be fit to a female connector;

a male terminal made of metal, partially embedded in the housing, projecting forward in a connecting direction from the housing and formed into a tubular shape, resin being filled inside the male terminal; and a resin cap configured to cover a tip of the male terminal on a front side in the connecting direction;

wherein the male terminal is provided with a communication opening in a part embedded in the housing, the communication opening allowing communication between inside and outside of the male terminal, and a projection is formed on an outer peripheral surface of the embedded part;

the resin constituting the housing and the resin filled inside the male terminal are integrated via the communication opening and the resin filled inside the male terminal and resin constituting the resin cap are integrated via an opening of the male terminal on the front side in the connecting direction;

the housing is formed with a recess configured to expose the projection to outside; and the male terminal includes a slit extending over an entire length at one position in a circumferential direction.

6. The male connector of claim 5, wherein the projection is separated from an outer peripheral wall of the male terminal except at a base end and rises outward from the outer peripheral wall.

7. The male connector of claim 5, wherein the projection is a convex part formed on the outer peripheral surface and a recess is formed at a position corresponding to the convex part in an inner peripheral surface of the male terminal.

8. The male connector of claim 5, wherein the projection is separated from an outer peripheral wall of the male terminal except at a base end and protrudes outward via a step.

9. A male connector, comprising:

a male terminal made of metal and having a tubular portion with opposite open front and rear ends, an intermediate portion extending from the rear end of the tubular portion, a connecting portion extending rearward from the intermediate portion, and a projection extending transversely from the tubular portion at a position spaced from the front end; and a housing made of resin and including a terminal holding portion surrounding and engaging the intermediate portion of the male terminal, a back wall surrounding and engaging both the rear end of the tubular portion and a rear facing surface of the projection, and a tubular housing wall projecting forward from the back wall and spaced radially outward from the tubular portion of the male terminal, the resin of the housing further extending through the open rear end of the tubular portion of the male terminal and forward beyond the front end of the tubular portion of the male terminal to define a cap forward of the front end of the tubular portion of the male terminal, the back wall of the housing including a forwardly open recess that exposes a forwardly facing surface of the projection of the male terminal at a position inward of the tubular housing wall.

10. The male connector of claim 9, wherein the projection is separated from an outer peripheral wall of the male terminal except at a base end and rises outward from the outer peripheral wall.

11. The male connector of claim 9, wherein the projection is a convex part formed on the outer peripheral surface and a recess is formed at a position corresponding to the convex part in an inner peripheral surface of the male terminal.

12. The male connector of claim 9, wherein the projection is separated from an outer peripheral wall of the male terminal except at a base end and protrudes outward via a step.

* * * * *